US006052085A

United States Patent [19]

Hanson et al.

[11] Patent Number: 6,052,085

[45] Date of Patent: Apr. 18, 2000

[54] METHOD AND SYSTEM FOR BEAMFORMING AT BASEBAND IN A COMMUNICATION SYSTEM

[75] Inventors: Duke E. Hanson, Queen Creek; James W. Startup, Chandler; Joel L. Gross; Jonathan Henry Gross, both of Gilbert; John Richard Erlick, Scottsdale, all of Ariz.

[73] Assignee: Motorola, Inc., Schaumburg, Ill.

[21] Appl. No.: 09/092,187

[22] Filed: Jun. 5, 1998

[51] Int. Cl.[7] ..... H01Q 3/22; H01Q 3/24; H01Q 3/26

[52] U.S. Cl. ..... 342/373

[58] Field of Search ..... 342/373, 368, 342/372

[56] References Cited

U.S. PATENT DOCUMENTS 3,711,855 1/1973 Schmidt et al. ..... 342/367
5,577,031 11/1996 Smith ..... 370/329
5,579,341 11/1996 Smith et al. ..... 455/101
5,754,138 5/1998 Turcotte et al. ..... 342/373
5,909,649 6/1999 Saunders ..... 455/464
5,917,447 6/1999 Wang et al. ..... 342/383

*Primary Examiner*—Thomas H. Tarcza
*Assistant Examiner*—Fred H Mull
*Attorney, Agent, or Firm*—Jeff D. Limon; Gregory J. Gorrie; James E. Klekotka

[57] ABSTRACT

In a satellite communication system, beamforming is performed at baseband frequencies forming only beams which convey information. A received signal is applied to a down-converter (FIG. 1, 30), followed by a channelizer (50), and digital beamformer (60). The order of operations being reversed in order to generate a transmit beam. By performing the beamforming at baseband, the system can be allowed to form only those beams which convey information between a communications node and a subscriber. As a result, the system provides communication services to subscribers in a more cost-effective manner.

16 Claims, 3 Drawing Sheets

METHOD AND SYSTEM FOR BEAMFORMING AT BASEBAND IN A COMMUNICATION SYSTEM

FIELD OF THE INVENTION

The invention relates generally to communication systems and, more particularly, to methods and systems for beamforming and channelization.

BACKGROUND OF THE INVENTION

In a communication system where multiple subscribers require a connection to a central communications node, techniques have been developed which provide channels between the subscribers and the communications node. In a communication system, such as a satellite-based communication system, it is desired that the satellite provide communication channels by generating receive and transmit antenna beams preferably in those directions where subscribers are located. This helps to minimize the resources which are needed to establish and maintain a communication channel between a terrestrial-based subscriber and the space-based communication satellite.

In communication systems, antenna beamforming techniques may be used to generate and steer communication beams toward areas occupied by terrestrial-based subscribers. Through the use of beamformers, receive and transmit communication beams can be generated to efficiently service only those areas of the earth occupied by subscribers. Typically, beamforming is performed at the carrier frequency or an intermediate frequency. However, performing the beamforming at the carrier or an intermediate frequency requires a level of complexity that is proportional to the bandwidth of the entire communication system node. Thus, in a typical satellite-based system, the complexity of the beamformer is proportional to the product of number of beams generated by the satellite multiplied by the available bandwidth per beam. Additionally, the satellite system is prone to generating transmit and receive beams that do not contain subscriber information. This additional complexity and inefficiency increases the cost of communication services to the subscribers.

Thus, what is needed are a method and system for efficiently generating transmit and receive communication beams using a reduced complexity beamformer.

What is also needed are a method and system for generating transmit and receive communication beams to service those areas of the earth occupied by subscribers.

BRIEF DESCRIPTION OF THE DRAWINGS

The invention is pointed out with particularity in the appended claims. However, a more complete understanding of the present invention may be derived by referring to the detailed description and claims when considered in connection with the figures, wherein like reference numbers refer to similar items throughout the figures, and:

The exemplification set out herein illustrates a preferred embodiment of the invention in one form thereof, and such exemplification is not intended to be construed as limiting in any manner.

DETAILED DESCRIPTIONS OF THE DRAWINGS

A method and system for baseband channelization and beamforming in a communication system facilitates, among other things, the efficient generation of transmit and receive beams which convey information between a subscriber and a node of the communication system. Through channelization and beamforming at baseband, as opposed to a carrier or an intermediate frequency, transmit and receive communication beams are generated for those subscribers which are actively engaged in a call. Additionally, since beams are generated on a per-subscriber basis, the resulting beamformer complexity is approximately proportional to the product of the number of subscribers multiplied by the bandwidth occupied by each subscriber. This level of complexity is viewed as being much less than a corresponding beamformer which operates at a carrier or an intermediate frequency.

Figure 1:
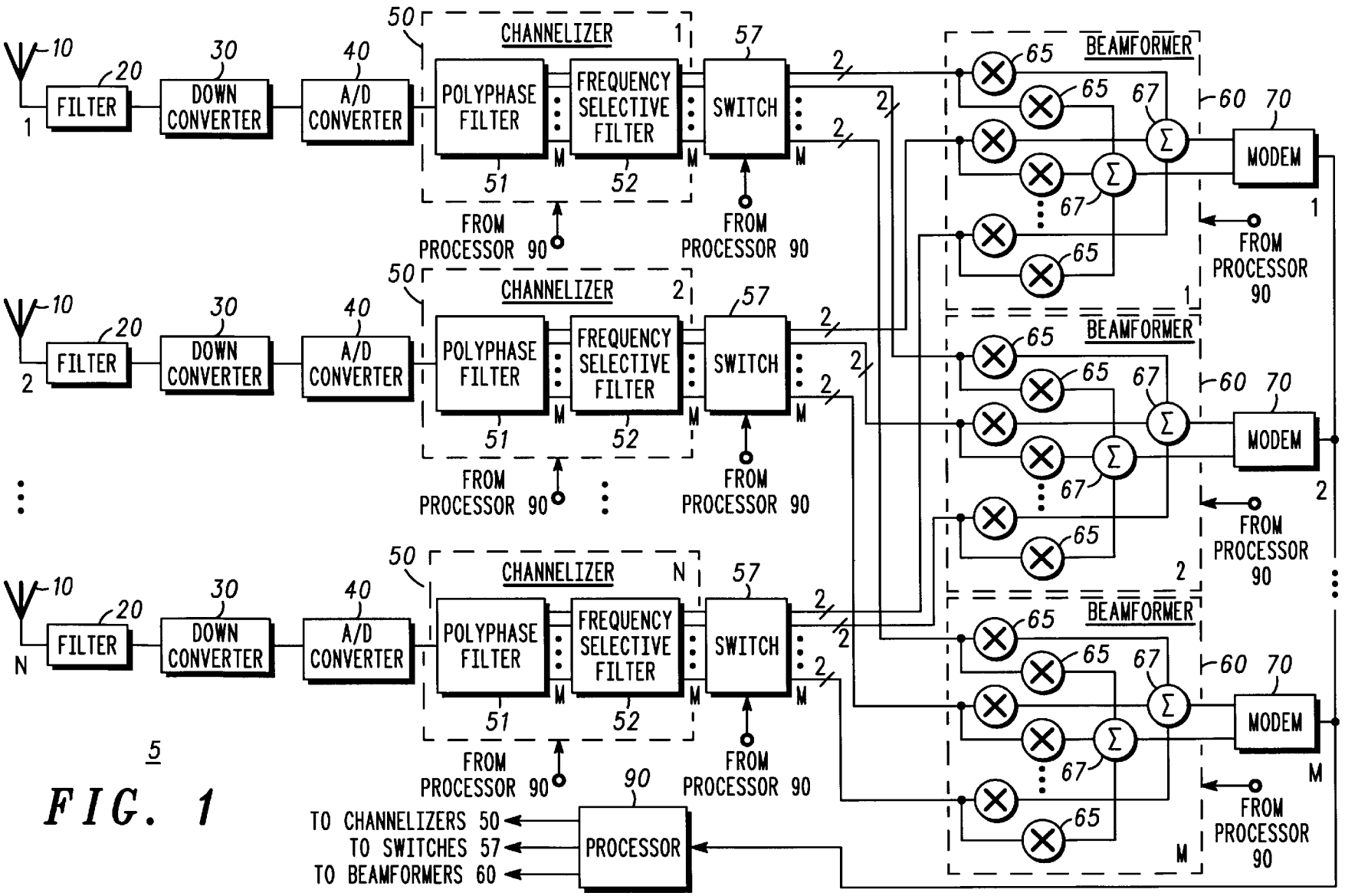
FIG. 1 illustrates a system for baseband receive channelization and beamforming in a communication system in accordance with a preferred embodiment of the present invention.

FIG. 1 illustrates a system (5) for baseband receive channelization and beamforming in a communication system in accordance with a preferred embodiment of the present invention. In FIG. 1, antenna elements 10 preferably are provided as part of a phased array antenna on a non-geostationary orbit communcation satellite which is part of a communication system having more than one satellite. Antenna elements 10 serve to receive element radio frequency signals transmitted from subscribers. In a preferred embodiment, each subscriber makes use of a satellite cellular telephone to communicate with system 5 of FIG. 1. Each satellite cellular telephone comprises at least a transceiver for receiving and transmitting message data which comprise analog voice, digitized voice, or binary data, and a processor for interpreting signaling information from system 5 so that frequency, time slot, or other communications channel assignments can be made. The transceiver and processor of each satellite cellular telephone, as well as the hardware architecture coupling these elements, are well known to those of ordinary skill in the art. Alternatively, message data to and from each subscriber may represent video, facsimile data, and so on. The message data may be transmitted to and received from a ground station or other earth-based terminal. In the preferred embodiment, system 5 communicates with other nodes of the communication system by way of conventional techniques such as radio frequency cross links.

In FIG. 1, antenna elements 10, desirably comprise an antenna array which comprises a plurality of "N" number of elements. In the preferred embodiment, the number of elements (N) ranges from 6000 to 10000 and is preferably around 8000, although more or less may be used in order to meet the specific link margin requirements of the particular application. Each of the plurality of antenna elements 10 can be of any type or construction such as a dipole, monopole above a ground plane, patch, or any element which receives an electromagnetic wave as a function of the electrical current present on the surface of the element. In another embodiment, each of antenna elements 10 are of the aperture type such as a waveguide slot, horn, or any type of element which receives an electromagnetic wave as a function of the electric field present within an aperture.

Subscribers communicate with system 5 through M receive beams. In the preferred embodiment, the number of receive beams (M) ranges from 1000 to 5000 and is preferably around 2000, although more or less may be used in order to accommodate the number of subscribers communicating with system 5. System 5 may generate a single receive antenna beam for each subscriber using a unique frequency channel for each, referred to as "frequency multiplexing". Additionally, when two or more subscribers are separated by a significant distance, system 5 may generate two or more receive beams using the same frequency channel, referred to as "spatial multiplexing". These multiplexing techniques serve to reduce the number of frequency channels required in order to serve the plurality of subscribers. In the preferred embodiment, the receive beams are both frequency and spatially multiplexed.

Each of the "N" antenna elements 10 of FIG. 1 receives element radio frequency signals from up to "M" receive beams. Thus, each of the "N" antenna elements may convey up to "M" element radio frequency signals to each of the filters coupled to each of antenna elements 10. In the preferred embodiment, one filter is used for each antenna element 10. Filters 20 serve to exclude frequency components of the "M" element radio frequency signals received by antenna elements 10 which are not within the desired band of operation for the communication system. Accordingly, each of filters 20 is desirably a bandpass filter structure. However, other types of filters, such as high pass, low pass, and band reject filters, may also be implemented according to the specific frequency rejection requirements of the particular communication system.

The filtered element radio frequency signals from filters 20 are input to downconverter 30. Downconverter 30 serves to shift the filtered element radio frequency signals to a lower frequency. Downconverter 30 may comprise one or more local oscillators and one or more mixers according to conventional downconverting techniques. In the preferred embodiment, downconverter 30 comprises an aggregate of downconverter elements, functionally providing one downconverter for each of the N antenna elements 10. The downconversion process of the element radio frequency signals from filters 20 provides element intermediate frequency signals in which preserve any frequency and spatially multiplexed attributes of the signal.

The element intermediate frequency signals from downconverter 30 are input to analog to digital converter 40. Analog to digital converter 40 desirably possesses sufficiently low quantization noise and adequate dynamic range to accurately digitize each of the N element intermediate frequency signals which are incident at the input. The resulting N digitized element intermediate frequency signals are present at the output of analog to digital converter 40. In the preferred embodiment, analog to digital converter 40 operates at a sampling rate higher than the Nyquist limit of the element intermediate frequency signals from downconverter 30. The sampling process provides a complex representation of each element intermediate frequency signal consisting of an in-phase and quadrature phased component for each of the N antenna elements.

The N digitized element intermediate frequency signals from analog to digital converter 40 are coupled to the input of channelizer 50. Channelizer 50 desirably has one input for each of the N antenna elements 10 with each input being filtered and transformed into a complex representation of the digitized element intermediate frequency signals. In the preferred embodiment, a system of N channelizers is used with each possessing M outputs.

In the preferred embodiment, each channelizer 50 comprises polyphase filter 51 and frequency selective filter 52. In a polyphase filter, deliberate aliasing is introduced by downsampling. At the output of polyphase filter 51, the desired in-phase and quadrature phased component for one of the M receive beam is combined with other, undesired in-phase and quadrature phased components from the other (M−1) receive beams. Due to the delays in the separate paths through polyphase filter 51, the in-phase and quadrature phased components from the other (M−1) receive beams will cancel at the summing node and leave only the desired in-phase and quadrature phased components from the desired receive beam. The use of a polyphase filter provides a computationally efficient technique of filtering a signal such as a digitized element intermediate frequency signals than other methods. A suitable text on the subject of polyphase filtering can be found in the book titled *"Multirate Digital Signal Processing"* by R. E. Crochiere & L. R. Rabiner, Prentice-Hall, 1983, ISBN-0136051626.

Each output of each polyphase filter 51 is conveyed to frequency selective filter 52 which may perform a fast Fourier or discrete Fourier transform. The use of frequency selective filter 52 at the output of polyphase filter 51 creates a polyphase filter bank. Thus, at the output of frequency selective filter 52, the in-phase and quadrature phased components from the desired subscriber are transformed into channel signals, which, in the preferred embodiment, are complex representations of the digitized element intermediate frequency signals.

In the preferred embodiment, each channelizer 50 is controlled by processor 90. Processor 90 provides control over the partitioning of each polyphase filter 51 as well as the resampling rate and the length of each filter within each channelizer 50. Processor 90 also controls the switching to allow complex representations of the digitized element intermediate frequency signals corresponding to a particular subscriber in a spatially multiplexed system to be present at the output of polyphase filter 51. Additionally, processor 90 controls the coefficients used to perform the fast Fourier or discrete Fourier transform, as well as the integration limits used to create the complex representations of the digitized element intermediate frequency signals.

The complex representations of each of the digitized element intermediate frequency signals output from each channelizer 50 are input to one of switches 57. In the preferred embodiment, N number of switches are provided with each containing M complex inputs and M complex outputs. Each switch 57 is controlled by way of processor 90 which, among other tasks, assigns each subscriber to a particular receive beam. Each switch 57 is used to enable a complex representation of each of the digitized element intermediate frequency signals output from channelizer 50 to be present on more than one output of each switch 57. Thus, for example, a particular input of switch 57 may be switched in order to be present at any one or more of the outputs of switch 57. In the preferred embodiment, the states of each of switches 57 are switched identically. The use of switches 57 allows more than one of the M subscribers to use the same frequency band. Thus, if two subscribers are using a specific frequency channel but different receive beams (spatial multiplexing), the complex representation of each of the digitized element intermediate frequency signals output from channelizer 50 may be alternately present at two outputs of each of switches 57. For those receive beams which do not employ spatial multiplexing, switch 57 directly connects a single input with a single output.

The complex representations of each of the digitized element intermediate frequency signals output from switches 57 are input to receive beamformers 60. In the preferred embodiment, a system of M receive beamformers with each having N complex inputs is used. Each of the receive beamformers 60 accepts an input from each of switches 57. As shown in FIG. 1, the first output of the first of switches 57 is coupled to the first input of beamformers 60. The first output of the second of switches 57 is coupled to the second input of the first of beamformers 60.

Each of receive beamformers 60 performs a complex multiplication on each of the inputs from switches 57. In the preferred embodiment, the real and imaginary parts of the N complex inputs are multiplied by a weighting factor preferably selected in accordance with the placement of the particular element in the antenna array. These multiplications correspond to shifting the amplitude and phase of each signal at each of antenna elements 10. Through the multiplication of each complex input by a selected weighting factor, a receive antenna beam is formed. The magnitude and phase of each weighting factor are controlled by processor 90 according to the pointing angle of the receive beam being generated by receive beamformer 60.

In the preferred embodiment, the real and imaginary products of multipliers 65 are added using adders 67. The resultant sums represent demultiplexed baseband subscriber information signals. Thus, the entire beamforming capability of each of beamformers 60 can be dedicated to a single subscriber.

A suitable text on the subject of digital beamforming can be found in the book titled *"Digital Beamforming in Wireless Communications"* by John Litva, Titus Lo; Artech House, 1996, ISBN: 0890067120.

At the output of each beamformer 60, a resulting demultiplexed baseband subscriber information signal is accepted by an input of modem 70. Modem 70 converts the complex baseband subscriber information into a data signal for use by other portions of the communication system. Modem 70 preferably includes sufficient processing, memory, and logic in order to perform any necessary error correction and detection on the demultiplexed baseband subscriber information signal in order to form a subscriber data message. At this point the data message routed to processor 90 so that the signal can be forwarded to other nodes in the communications system.

Thus, system 5 has the capability to generate a single receive antenna beam to be allocated for each subscriber. Thus, antenna 10 can form a highly directional beam that pinpoints a particular subscriber without losses in antenna gain caused by the need to form a high gain beam that encompasses a large angular area.

Figure 2:
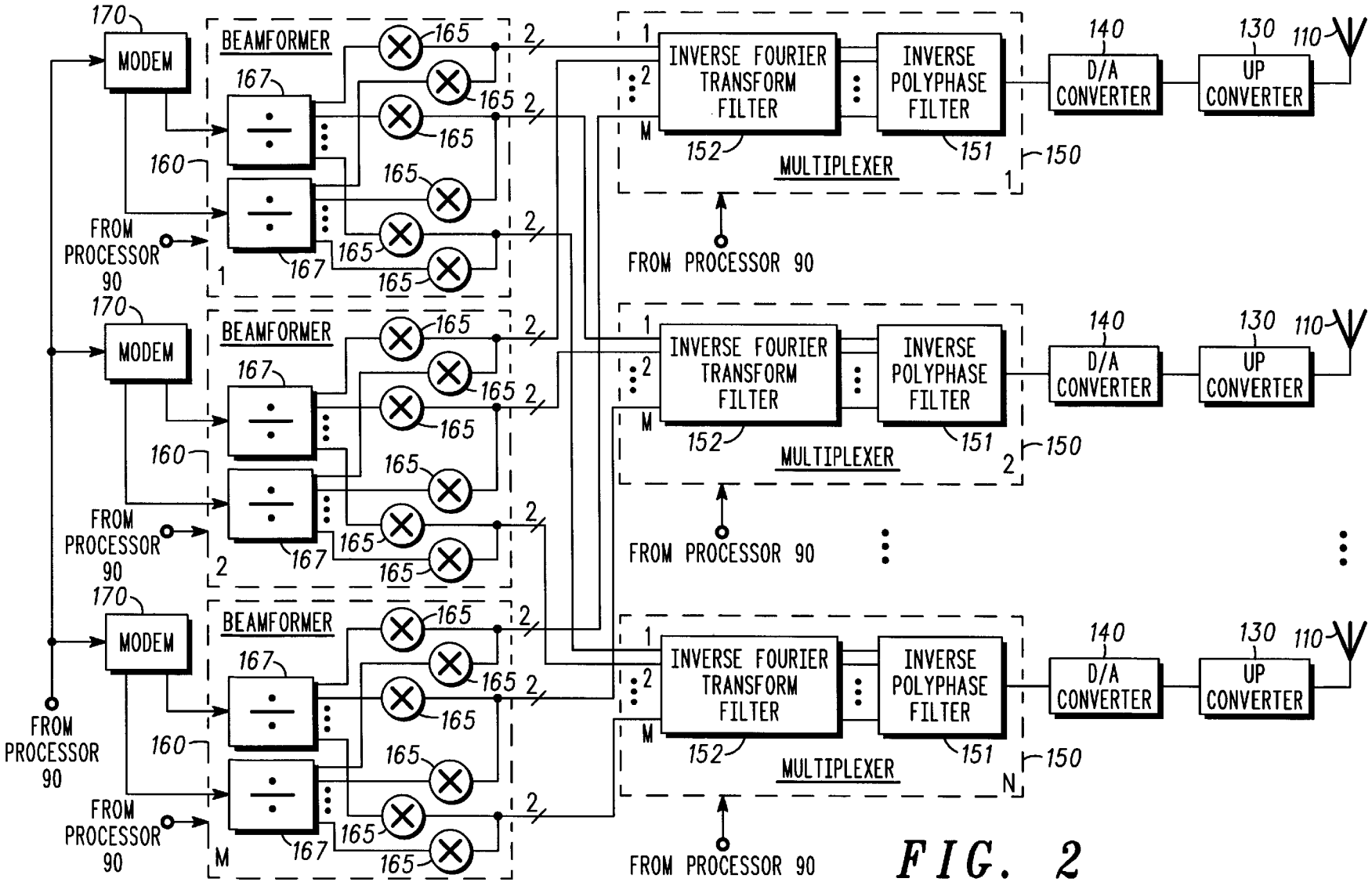
FIG. 2 illustrates a system for baseband transmit channelization and beamforming in a communication system in accordance with a preferred embodiment of the present invention.

FIG. 2 illustrates a system (100) for baseband transmit channelization and beamforming in a communication system in accordance with the preferred embodiment of the present invention. The operations discussed in reference to FIG. 2 are substantially the reverse of those operations discussed in reference to FIG. 1. In the preferred embodiment, a data message which represents information to be transmitted to a subscriber is incident on one of modems 170. In the preferred embodiment, a system of M number of modems 170 are present with each being coupled to one of the M number of transmit beamformers 160. Each modem 170 adds error control coding as required in order to ensure error free transmission from system 5 to a subscriber. Modem 170 converts the data message to a complex baseband subscriber information signal, preferably in digital form, and conveys this to an input of transmit beamformer 160. Transmit beamformer 160 comprises elements similar to beamformer 60 including multiplier 165.

In the preferred embodiment, divider 167 of transmit beamformer 160 serves to perform the opposite task as that performed by adder 67. Divider 167 divides an incoming complex baseband subscriber information signal from modem 170 into N real and imaginary components. The N outputs of dividers 167 are input to multipliers 165. Each of multipliers 165 multiplies each of the N complex inputs by a weighting factor selected by processor 90 in accordance with the particular element in the antenna array and the pointing angle required by the particular transmit antenna beam. The multiplication by weighting factors, which occurs in a digital domain, corresponds to shifting the amplitude and phase of each signal at a particular one of antenna elements 110. Through this shifting of the phase and amplitude of the N signals coupled to antenna elements 110, a transmit beam is formed In the preferred embodiment, each of the M beamformers 160 includes N complex outputs. As shown in FIG. 1, the first output of each beamformer is coupled to the first input of each multiplexer 150. Similarly, the second output of each beamformer 160 is coupled to the second input of each multiplexer 150. The interconnections of each of the N outputs of beamformer 160 to each of the M inputs of multiplexer 150 continue in this manner.

Multiplexer 150 performs a function opposite to that performed by channelizer 50. Multiplexer 150 preferably multiplexes each of the complex representations of the digitized element intermediate frequency signals using an inverse polyphase filter and inverse Fourier Transform filter bank to form a digitized element intermediate frequency signal. This results is each digitized element intermediate frequency signal being both spatially and frequency multiplexed. In the preferred embodiment, processor 90 controls inverse polyphase filter 151 and inverse Fourier Transform filter 152 of multiplexer 150.

Note that no special switching similar to that performed by switches 57 of system 5 is required since the multiplexing operation involves the creation of a substantially linear combination of each of the M inputs to form a single digitized element intermediate frequency signal for each of the N multiplexers 150.

The output of each multiplexer 150 is input to digital to analog converter 140. Digital to analog converter 140 converts each of the digitized element intermediate frequency signals to element intermediate frequency signals. Desirably, each digital to analog converter 140 provides sufficient resolution in order to produce an accurate element intermediate frequency signals from each digitized element intermediate frequency signal present at the input. The element intermediate frequency signals output from each digital to analog converter 140 is upconverted by upconverter 130 and coupled to transmit antenna elements 110.

Because the process of transmit beamforming begins with a subscriber data message, as described above, the process may be executed when the data message is present, and terminated when all data message for a particular subscriber have been transmitted. Thus, the communication system can generate a beam based on an active subscriber and terminate the beam when the subscriber is no longer active.

Figure 3:
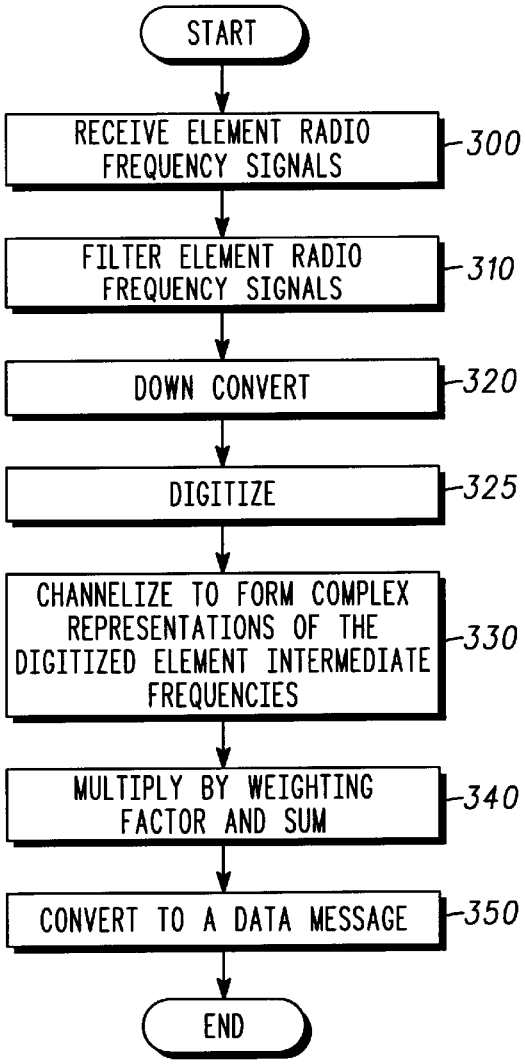
FIG. 3 illustrates a simplified procedure for baseband receive channelization and beamforming in a communication system in accordance with a preferred embodiment of the invention.

FIG. 3 illustrates a simplified procedure for baseband receive channelization and beamforming in a communication system in accordance with a preferred embodiment of the invention. System 5 (FIG. 1) is suitable for performing the method. In step 300, an antenna or other suitable device for receiving electromagnetic energy, receives element radio frequency signals which represent a data message from a subscriber. In step 310, these element radio frequency signals are filtered by a filter having suitable frequency rejection characteristics. The filtered element radio frequency signals resulting from step 310 are downconverted in step 320. The resulting element intermediate frequency signals are digitized in step 325 to form digitized element intermediate frequency signals. In step 330 the digitized element intermediate frequency signals are channelized to form complex representations of the digitized element intermediate frequency signals. In step 340, these complex representations of the digitized element intermediate frequency signals are multiplied by a weighting factor and summed to form demultiplexed baseband subscriber information signals. In step 350, the demultiplexed baseband subscriber information signals are converted to a data message and conveyed to processor 90 so that the message can be forwarded to other nodes in the communications system.

Figure 4:
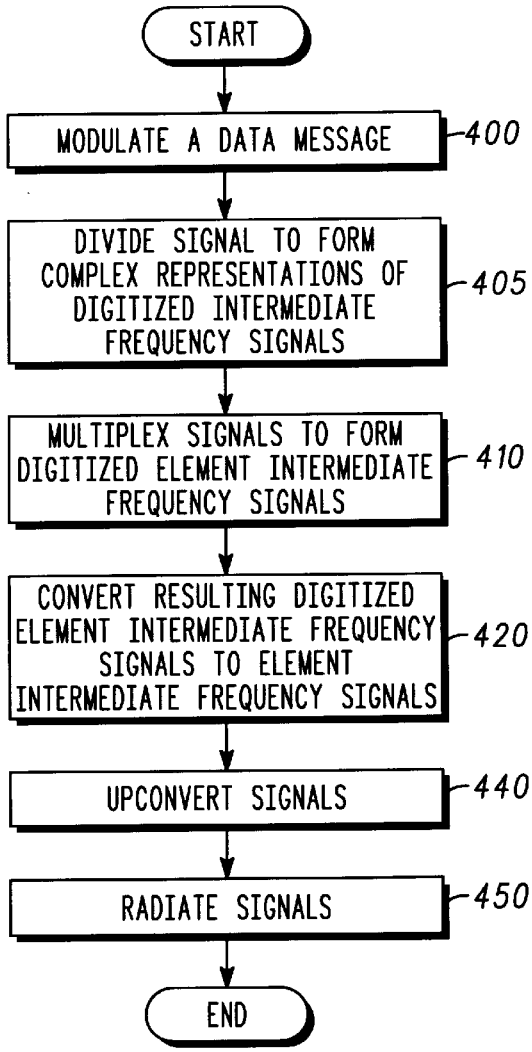
FIG. 4 illustrates a simplified procedure for baseband transmit channelization and beamforming in a communication system in accordance with a preferred embodiment of the present invention.

FIG. 4 illustrates a simplified procedure for baseband transmit channelization and beamforming in a communication system in accordance with a preferred embodiment of the present invention. System 150 of FIG. 2 is suitable for performing the method. In step 400, a data message from a processor is modulated to form a demultiplexed baseband subscriber information signal. In step 405 the demultiplexed baseband subscriber information signal is summed and divided to form complex representations of digitized intermediate frequency signals. In step 410, the complex representations of digitized intermediate frequency signals are multiplexed through the use of an inverse fast Fourier transform and inverse polyphase filtering. In step 420, the resulting digitized element intermediate frequency signals are converted to analog in resulting in element intermediate frequency signals. In step 440, the element intermediate frequency signals are upconverted to form element radio frequency signals and radiated in step 450.

A method and system for baseband channelization and beamforming in a communication system enables the efficient generation of transmit and receive beams which convey information between a subscriber and a node of the communication system. Through channelization and beamforming at baseband as opposed to a carrier or an intermediate frequency, transmit and receive communication beams are generated desirably for subscribers which are active at a given time. These beams are shaped and directed in order to provide maximum antenna gain to each subscriber. Since each subscriber communicates with the system through a dedicated antenna beam, this allows the system to provide communication services to subscribers in a more cost-effective manner. Additionally, the resulting beamformer complexity is approximately proportional to the product of the number of subscribers multiplied by the bandwidth occupied by each subscriber. This level of complexity is viewed as being much less than a corresponding beamformer which operates at a carrier or an intermediate frequency.

The foregoing description of the specific embodiments will so fully reveal the general nature of the invention that others can, by applying current knowledge, readily modify and/or adapt for various applications such specific embodiment without departing from the generic concept, and therefore such adaptations and modifications should and are intended to be comprehended within the meaning and range of equivalents of the disclosed embodiments.

It is to be understood that the phraseology or terminology employed herein is for the purpose of description and not limitation. Accordingly, the invention is intended to embrace all such alternatives, modifications, equivalents and variations as fall within the true spirit and broad scope of the appended claims.

What is claimed is:

1. A method of communicating with subscriber units comprising the steps of:

converting baseband signals received through elements of a phased array antenna to digital form;

for each element, separating the digital form of the received signals into a plurality of channel sets using a polyphase filter, each channel set having corresponding channels with other channel sets, one signal of each channel set being associated with one channel;

combining signals for the corresponding channels of each channel set to form channel signals for each channel set; and providing one channel signal for a subscriber unit.

2. A method as claimed in claim 1 wherein the converting step includes the step of converting RF signals received from two subscriber units on a same frequency band, said two subscriber units providing the RF signals in different receive antenna beams, the method further comprising the step of:

alternatively switching signals from the channel sets for the two subscriber units, and wherein the providing step includes the step of providing a switched channel signal for each of the two subscriber units.

3. A method as claimed in claim 2 wherein in the converting step, the phased array antenna is provided by a communication satellite in non-geostationary orbit, and wherein the providing step, the channel signals are provided to another communication satellite in non-geostationary orbit in packetized form for subsequent transfer to a recipient subscriber unit.

4. A method as claimed in claim 3 further comprising the step of transmitting RF signals to subscriber units, the transmitting step comprising the steps of:

separating channel signals for each subscriber unit into channel set signals, one channel set signal from each subscriber unit corresponding with one element of the phased array antenna;

digitally combining channel set signals of different components into an element signal for each element; and providing the element signals to corresponding elements of the phased array antenna.

5. A method for generating a receive antenna beam from a communication system, said receive antenna beam conveying a data message from subscriber to said communication system, said method comprising the steps of:

receiving a signal from said subscriber through said receive antenna beam using a plurality of antenna elements to form a plurality of element radio frequency signals;

downconverting said plurality of element radio frequency signals to form corresponding element intermediate frequency signals;

digitizing said plurality of element intermediate frequency signals to form digitized element intermediate frequency signals;

channelizing each digitized element intermediate frequency signal using a polyphase filter to form a plurality of complex representations for each digitized element intermediate frequency signal;

multiplying real and imaginary parts of each complex representation by a weighting factor to form a plurality of real and imaginary products for each complex representation;

summing said real and imaginary products for each complex representation to form demultiplexed baseband subscriber information signals; and converting each demultiplexed baseband subscriber information signals to a data message.

6. The method of claim 5, wherein each complex representation for each digitized element intermediate frequency signal corresponds to a channel signal.

7. The method of claim 5, wherein said channelizing step additionally comprises the step of applying a fast Fourier transform to said plurality of digitized element intermediate frequency signals to provide complex representations for each digitized element intermediate frequency signal.

8. A method as claimed in claim 5 wherein the converting step includes the step of converting RF signals received from two subscriber units on a same frequency band, said two subscriber units providing the RF signals in different receive antenna beams, the method further comprising the step of:

alternatively switching signals from the channel sets for the two subscriber units, and wherein the providing step includes the step of providing a switched channel signal for each of the two subscriber units.

9. A method for baseband channelization and beamforming in a communication system, said communication system generating a receive antenna beam which conveys data from a subscriber to said communication system, said method comprising the steps of:

digitizing a plurality of element intermediate frequency signals to form corresponding digitized element intermediate frequency signals;

channelizing each digitized element intermediate frequency signal using a polyphase filter to form a plurality of complex representations for each digitized element intermediate frequency signal;

multiplying real and imaginary parts of each complex representation by a weighting factor to form real and imaginary products for each digitized element intermediate frequency signal; and summing each of said real and imaginary products for each digitized element intermediate frequency signal to form demultiplexed baseband subscriber information signals which beam which convey a data message from said subscriber.

10. The method of claim 9, wherein said channelizing step additionally comprises the step of applying a fast Fourier transform to said plurality of element intermediate frequency signal to provide complex representations for each digitized element intermediate frequency signal.

11. A method as claimed in claim 9 wherein the converting step includes the step of converting RF signals received from two subscriber units on a same frequency band, said two subscriber units providing the RF signals in different receive antenna beams, the method further comprising the step of:

alternatively switching signals from the channel sets for the two subscriber units; and wherein the providing step includes the step of providing a switched channel signal for each of the two subscriber units.

12. A method for baseband channelization and beamforming in a communication system, said communication system generating a transmit antenna beam which conveys message data to a subscriber from a communication system, said method comprising the steps of:

converting a data message to a demultiplexed baseband subscriber information signal;

dividing said demultiplexed baseband subscriber information signal into real and imaginary parts;

multiplying said real and imaginary parts by weighting factors to form complex representations of digitized element intermediate frequency signals;

multiplexing said complex representations of digitized element intermediate frequency signals to form a plurality of digitized element intermediate frequency signals for each complex representation, said multiplexing step additionally comprising performing polyphase filtering on said plurality of complex representations of digitized element intermediate frequency signals;

converting digitized element intermediate frequency signals to element intermediate frequency signals; and upconverting said element intermediate frequency signals to form element radio frequency signals which convey said message data to said subscriber from said communication system.

13. A method for baseband channelization and receive beamforming in a communication system, said communication system generating a transmit communication beam which enables said communication system to transmit a signal to a subscriber through an antenna, said method comprising:

dividing demultiplexed baseband subscriber information signal into real and imaginary parts;

multiplying said real and imaginary parts by weighting factors to form a plurality of complex representations of digitized element intermediate frequency signals;

multiplexing said plurality of complex representations of digitized element intermediate frequency signals using a polyphase filter to form a plurality of digitized element intermediate frequency signals; and converting said plurality of digitized element intermediate frequency signals to a plurality of element intermediate frequency signals.

14. The method of claim 13, wherein said multiplexing step comprises the additional step of performing an inverse fast Fourier transform on said plurality of complex representations of digitized element intermediate frequency signals.

15. A system for demultiplexing signals in a communication system, said communication system generating at least one transmit communication beam which enables said communication system to transmit a signal to at least one of a plurality of subscribers through an antenna, said system comprising:

a divider which divides a demultiplexed baseband subscriber information signal into real and imaginary parts;

a multiplier which multiplies said real and imaginary parts by weighting factors to form a plurality of complex representations of digitized element intermediate frequency signals; and a multiplexer which multiplexes said plurality of complex representations of digitized element intermediate frequency signals to form a plurality of digitized element intermediate frequency signals, said multiplexer additionally comprising an inverse polyphase filter.

16. The system of claim 15, wherein said multiplexer additionally comprises a filter bank which performs an inverse fast Fourier transform.

* * * * *